United States Patent [19]

Honegger et al.

[11] 4,072,228

[45] Feb. 7, 1978

[54] APPARATUS FOR EVENING AN IMBRICATED STREAM OF PRINTED PRODUCTS

[75] Inventors: Werner Honegger, Ruti; Erwin Müller, Durnten, both of Switzerland

[73] Assignee: Ferag AG, Hinwil, Switzerland

[21] Appl. No.: 686,143

[22] Filed: May 13, 1976

[30] Foreign Application Priority Data

May 20, 1975 Switzerland ..... 6461/75

[51] Int. Cl.[2] ..... B65G 47/28

[52] U.S. Cl. ..... 198/459; 198/466; 198/792; 271/202

[58] Field of Search ..... 198/460, 459, 461, 462, 198/334, 423, 466, 792; 271/202, 203, 204

[56] References Cited

U.S. PATENT DOCUMENTS

| | | | |
|---|---|---|---|
| 2,752,883 | 7/1956 | Curtis | 198/461 |
| 2,755,611 | 7/1956 | McGihon | 198/459 |
| 3,232,414 | 2/1966 | Brigham et al. | 198/461 |
| 3,346,096 | 10/1967 | Johnson | 198/461 |
| 3,572,498 | 3/1971 | Hammitt | 198/792 |
| 3,671,035 | 6/1972 | Reist | 271/202 |
| 3,695,183 | 10/1972 | Zuppiger | 198/792 |
| 3,712,448 | 1/1973 | Burson et al. | 198/334 |
| 3,719,267 | 3/1973 | Reist et al. | 198/466 |
| 3,809,214 | 5/1974 | Reist | 271/204 |
| 3,830,360 | 8/1974 | Graff et al. | 198/655 |
| 3,842,961 | 10/1974 | Burson | 198/334 |
| 3,955,667 | 5/1976 | Müller et al. | 271/204 |
| 3,987,889 | 10/1976 | Godoy | 198/655 |
| 4,007,824 | 2/1977 | Reist | 198/472 |

FOREIGN PATENT DOCUMENTS

| | | | |
|---|---|---|---|
| 1,198,288 | 12/1961 | Germany | 198/462 |

*Primary Examiner*—John J. Love
*Assistant Examiner*—Richard K. Thomson
*Attorney, Agent, or Firm*—Werner W. Kleeman

[57] ABSTRACT

An apparatus for evening a printed stream of printed products comprising a number of revolving entrainment members which are in a drag connection with one another. At the region of their conveying-active path the entrainment members are guided and at the start of this path driven by a thrust drive and at the end thereof driven by a traction drive. The entrainment members engage the printed products and the thrust and traction drives cause a change in the spacing of the entrainment members and, consequently, in the spacing of the products.

13 Claims, 11 Drawing Figures

APPARATUS FOR EVENING AN IMBRICATED STREAM OF PRINTED PRODUCTS

BACKGROUND OF THE INVENTION

The present invention relates to a new and improved construction of apparatus for making uniform or evening an imbricated stream of products, especially printed products.

Even when an imbricated stream of printed products directly appears at a rotary printing press the spacing of the individual products from one another within the imbricated product stream continually experiences deviations. In many cases, however, a prerequisite for the direct further processing of an imbricated product stream is that there is present a uniform spacing of the imbricated products within the stream from one another. Apart from this there can also be present the need that the products are delivered properly in-phase to a processing device.

SUMMARY OF THE INVENTION

It is a primary object of the present invention to provide an apparatus which effectively fulfills the aforementioned requirements.

A further object of the invention aims at the provision of a new and improved construction of apparatus for evening an imbricated stream of products, especially printed products, which apparatus is relatively simple in construction, extremely reliable in operation, not readily subject to breakdown or malfunction, and requires a minimum of servicing and maintenance.

Now in order to implement these and still further objects of the invention, which will become more readily apparent as the description proceeds, the apparatus of this development is manifested by the features that there are provided a number of revolving entrainment members which are in a drag connection with one another. At the region of their conveying-active path these entrainment members are guided and at the start of such path are driven by a thrust or push drive and at the end of such path are driven by a traction or pull drive.

The entrainment members driven in thrust operation at the start of their conveying-active path possess a mutual spacing corresponding to the average spacing of the imbricated products, so that each printed product in the imbricated array has associated therewith an entrainment member. Owing to the traction or tension drive at the end of the conveying-active path the mutual spacing of the entrainment members increases on the other hand to a size which is always the same between two neighboring entrainment members and determined by the drag connection, and wherein this spacing of the entrainment members is transmitted to the imbricated product formation in the form of a uniform spacing of the imbricated products in contrast to the original enlarged product spacing. Stated in another way: the entrainment members which have been pulled apart by the traction drive stretch the imbricated product formation while at the same time evening out or making uniform the spacing of the imbricated products.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
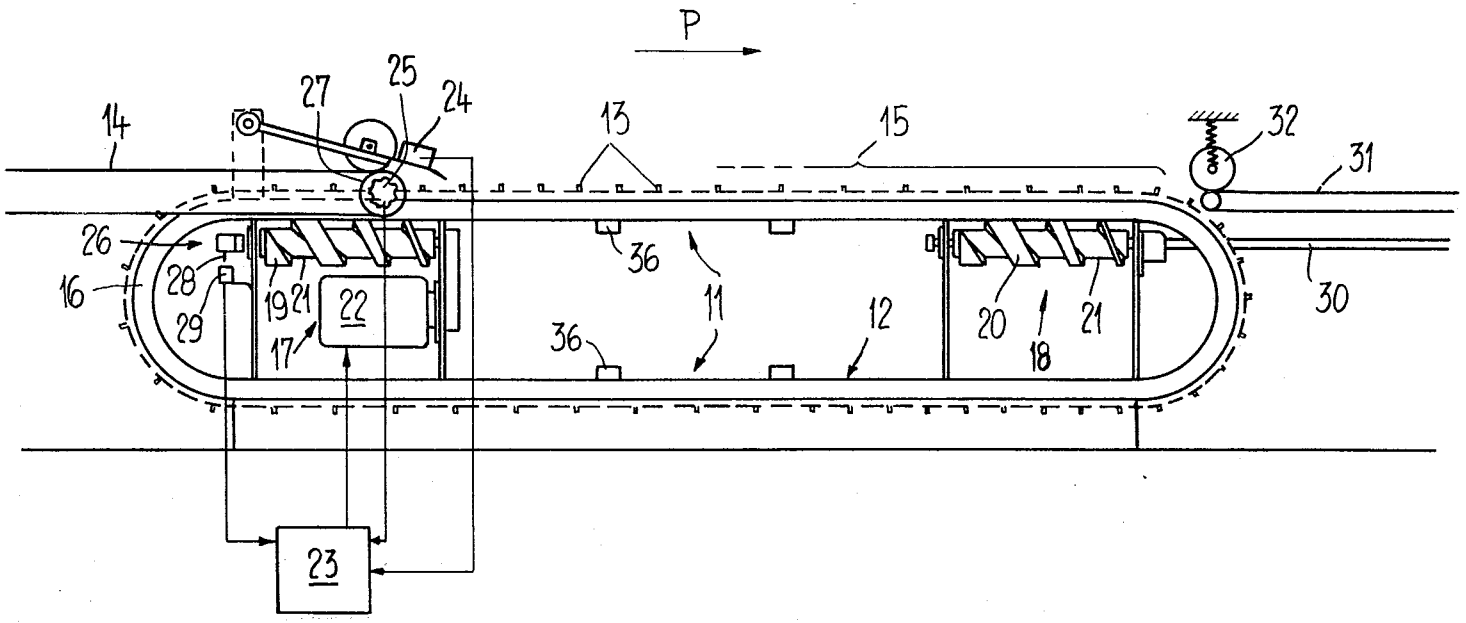
FIG. 1 is a side view of a first exemplary embodiment of apparatus constructed according to the invention.

Describing now the drawings, with the exemplary embodiment of FIG. 1 the endless path of travel 11 is constituted by a substantially flat-oval hollow rail or rail member 12 in which there are displaceably guided the entrainment members 13 which have only been schematically illustrated in FIG. 1 and as will be explained more fully hereinafter. The imbricated product formation —which is not shown in FIG. 1— is delivered by means of a conveyor band or belt 14 or equivalent structure to the upper branch or path 15 of the revolving path of travel 11. This branch or path 15, as will be explained more fully hereinafter, encompasses the conveying-active path of the revolving path of travel or track 11 and therefore can be equated thereto. On the other hand, the circular or revolving path of travel 11 at the region of its arc-shaped path 16 extends towards the conveying path represented by the conveyor band 14, whereby, as already indicated, the entrainment members 13 are introduced to the imbricated product stream. The arrangement is undertaken such that the entrainment members each can engage behind the trailing edge of an associated printed product.

At the start and at the end of the conveying-active path or run 15 of the circular path 11 there is arranged a respective drive for the entrainment members 13, one of the drives being indicated in its entirety by reference character 17 and the other by reference character 18. These drives engage directly at the entrainment members. Each of these drives comprises a conveyor worm 19 and 20 wherein the pitch or lead of the worm threads —in both instances designated by reference character 21— decreases in the direction of the arrow P. This arrow P designates the general conveying direction which is applicable for all conveying-active components of the apparatus of FIG. 1. The worm 19 is driven by an electric motor which can be speed controlled. Particularly suitable are direct-current motors which can be accelerated or braked within milliseconds. The motor 22 is controlled by an electronic phase synchronizing device 23 which receives its input signals from a counter 24, a cycle disk 25 and a proximity switch 26. The counter 24 is actuated in conventional manner by the edges of the printed products moving past. The cycle disk 25 is arranged at the deflecting roll or roller 27 of the conveyor band 14, and its rotational speed is thus proportional to the speed of the conveyor band 14. The cycle disk 25 should be considered as symbolic for a tacho generator. This symbolic illustration is justified in consideration of the intent to simplify the showing of the drawings. The proximity switch 26 possesses a cam 28 revolving with the worm 19 as well as a signal transmitter 29 which, as should be readily apparent from the arrangement under consideration, delivers signals to the device 23 in a predetermined rotational position of the worm.

The worm 20 is driven by shaft 30, the rotation of which, as will be explained more fully hereinafter, basically represents a qualified requirement for printed products arriving in an imbricated product stream and which exists in the course of the manipulation of the imbricated product stream in the conveying device under discussion. Thus, for instance, one can be concerned with supplying in-phase a stuffing machine. The shaft 30 then would be connected with the drive of the stuffing machine. However, it is to be mentioned that this example is only given for purposes of explanation and not limitation. For the same reasons and without intending to be limiting in any way whatsoever there are also given the following explanations. The further conveying of the imbricated product stream occurs with the aid of a conveyor band 31 which cooperates with a contact or press-on roll 32 and driven at a speed proportional to the rotational speed of the shaft 30.

Figure 5:
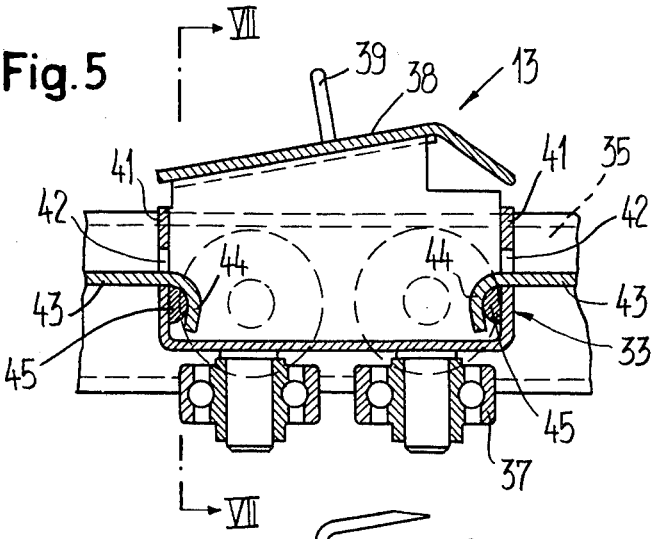
FIG. 5 is a sectional view of an entrainment member taken substantially along the line V—V of FIG. 7.
Figure 6:
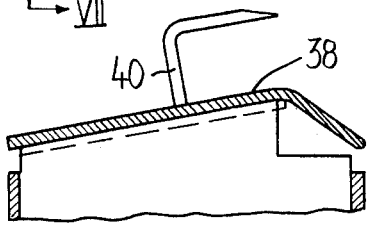
FIG. 6 is a fragmentary sectional view of a modified construction of entrainment member.
Figure 7:
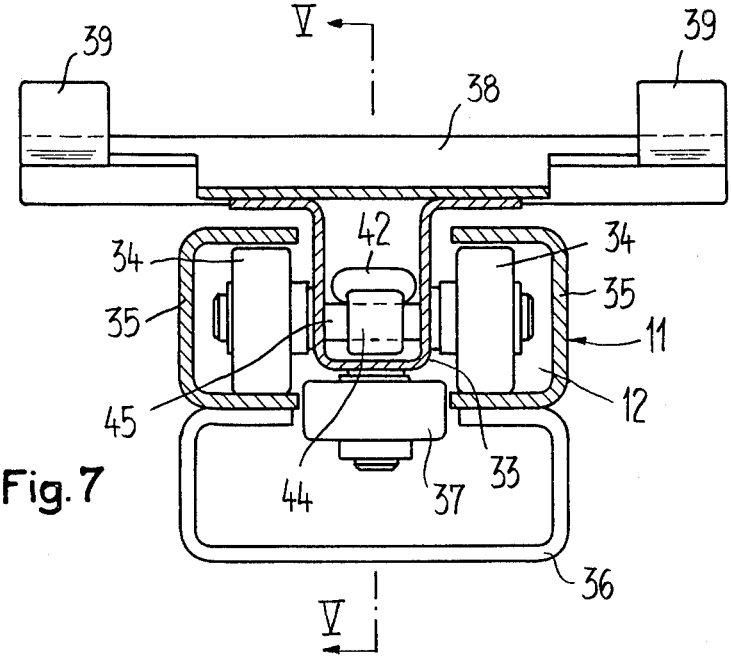
FIG. 7 is a sectional view of the entrainment member of FIG. 5, taken substantially along the line VII-VII thereof.

At this point reference is made to FIG. 5 et seq in order to understand the following description. It will be seen that each of the entrainment members 13 has a substantially box-shaped undercarriage or frame 33 which are guided with the aid of wheels 34 arranged in pairs at its two sides in the channel or rail 12 of the circular track or path 11. This channel 12 is formed by rails 35 of substantially U-shaped configuration in cross-section, these rails confronting one another with their open sides and being in spaced relationship and interconnected with the aid of brackets 36 (see also FIG. 1). At the underside of the undercarriage 33 there are arranged additional wheels 37 serving for the lateral guiding of the undercarriage. At its upper side each of the undercarriages 33 carries a roof-shaped bearing or support plate 38 which so-to-speak off-loads to both sides. Each support or bearing plate 38 possesses angled entrainment webs or members 39. In the embodiment of FIG. 6 the support to bearing plate 38 carries entrainment hooks 40.

Figure 8:
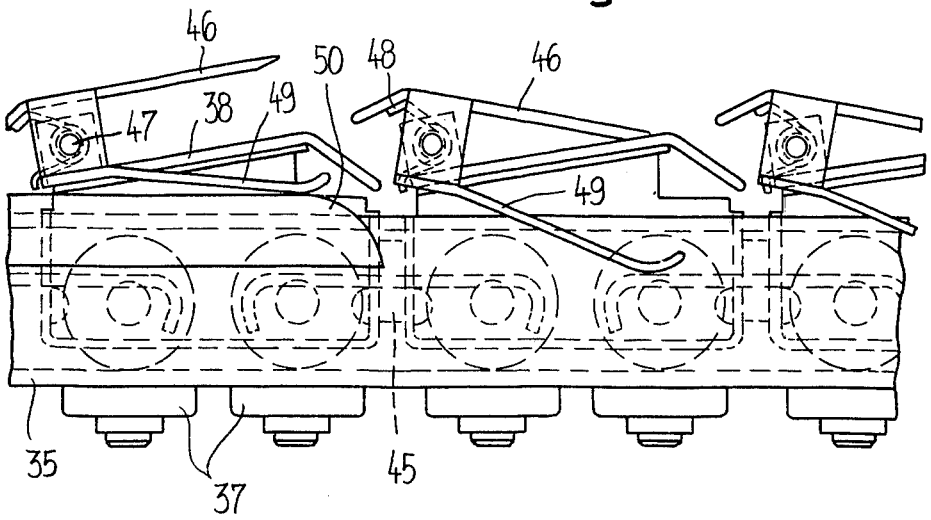
FIG. 8 is a fragmentary side view of a number of entrainment members and the manner in which they are interconnected, the entrainment members being shown in one position relative to one another and being equipped with controllable clamps.

At the front and rear end wall 41 of each of the undercarriages 33 there are provided openings 42 into which engage in each case a connection element 43. The connection elements 43 carry at each end a hook 44 engaging about an impact ledge 45. As will be particularly apparent by referring to FIGS. 8 and 9, it is thus possible to establish a drag connection of the undercarriages of neighboring entrainment members with one another, wherein each undercarriages, on the one hand, is entrained by the neighboring undercarriages in the direction of conveying and, on the other hand, can however overtake i.e. catch up to the last-mentioned undercarriage. In fact, FIG. 9 illustrates the undercarriage in the drag position and FIG. 8 illustrates undercarriages which have run-on to one another.

Figure 2:
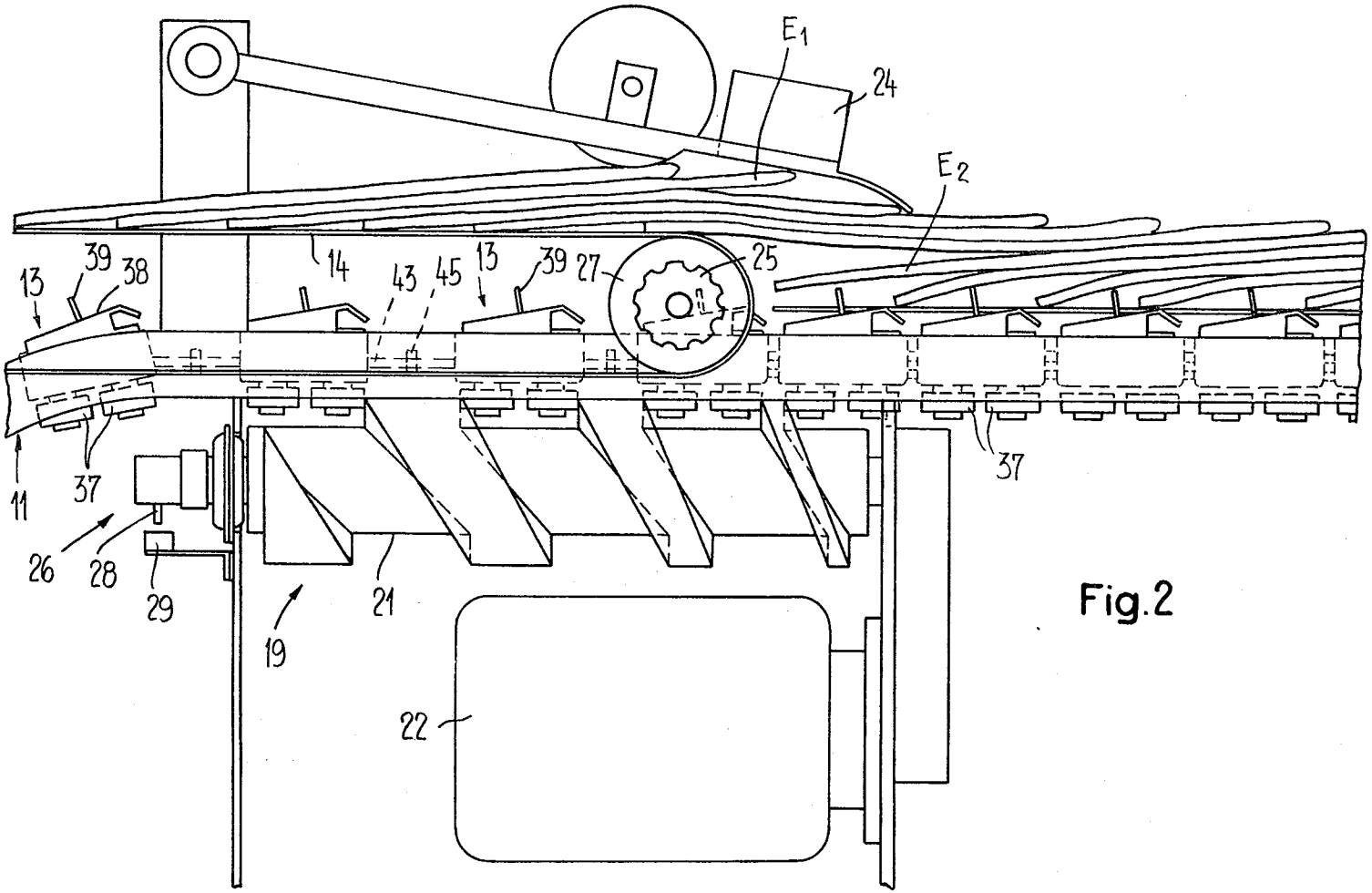
FIG. 2 is an enlarged view of the conveying-active path of the apparatus of FIG. 1 at the left-hand side thereof.
Figure 4:
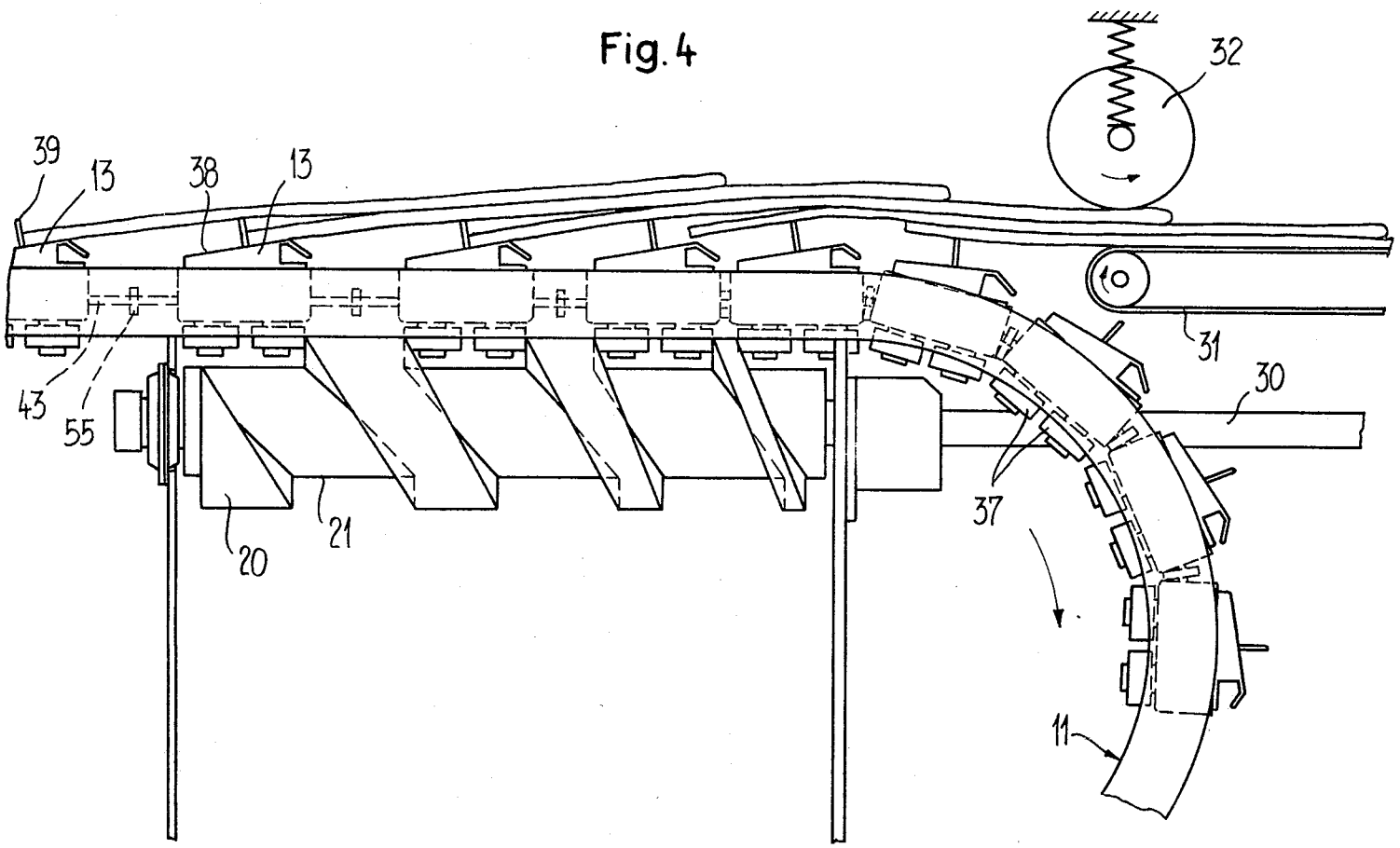
FIG. 4 is an enlarged view of a section of the conveying-active path of the apparatus of FIG. 1 at the right-hand side thereof.
Figure 9:
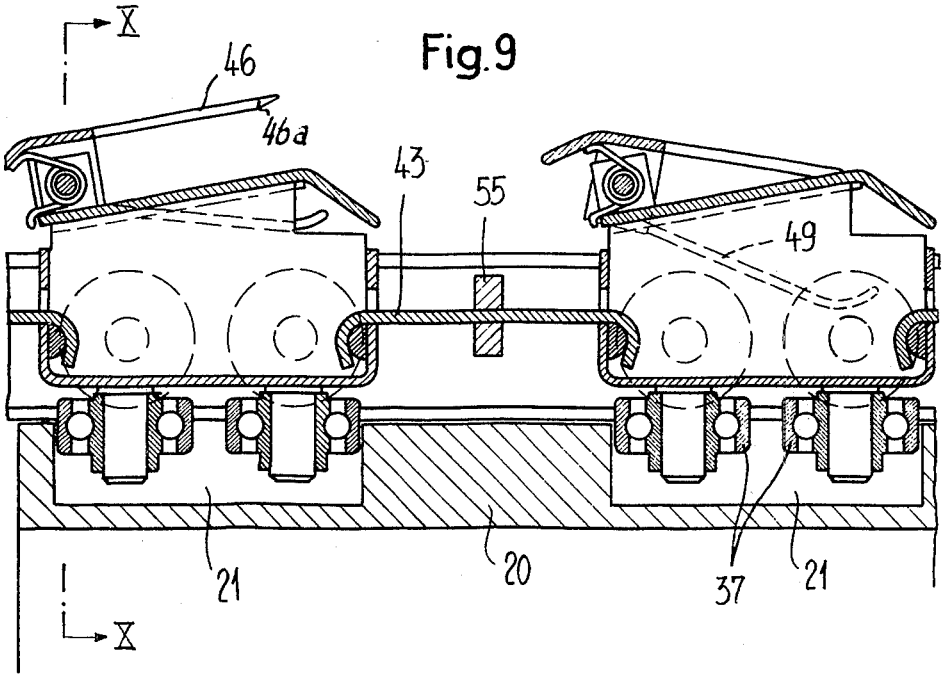
FIG. 9 is an elevational sectional view, similar to the showing of FIG. 8, illustrating the entrainment members in a different relative position.

From the showing of FIGS. 2 and 4 as well as FIG. 9 there will be recognized that the wheels 37 also serve the purpose of engaging into the threads 21 of the worms 19 and 20 respectively and to transmit the feed movement produced by such worms to the undercarriages 33. As will be seen from FIGS. 2 and 4 the engagement of the wheels or rollers 37 into the worm threads 21 is only possible in a predetermined rotational range of the worms 19 and 20 respectively. On the other hand, the pitch at the start of the worms 19 and 20 and the mutual spacing of the entrainment members 13 in the drag position is chosen such that the worms, during each revolution, can engage the next dragged-in entrainment member. However, since as stated the pitch of the worm thread 21 decreases the trailing entrainment members move closer to the momentarily preceding entrainment member already in the operable region of the worm to approximately such an extent until they strike against one another by means of a buffer or shock aborber 55 (see particularly FIG. 9) arranged at each of the connection elements. With this in mind it is possible to state that the worms 19 and 20 drive the entrainment members, but at the same time dam-up such. Stated in another way the sections of the circular path following the worms 19 and 20 constitute dam-up zones.

Figure 3:
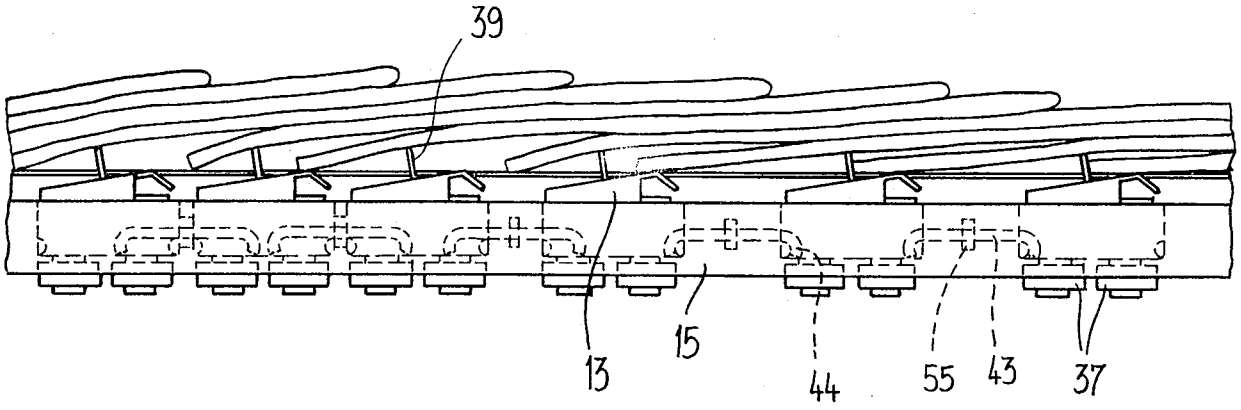
FIG. 3 is an enlarged view of the next following or intermediate section of the conveying-active path of the apparatus of FIG. 1.

Conversely, the sections located in front of the worms 19 and 20 respectively, are to be considered as stretching zones. This will be best recognized by referring to FIGS. 2, 3 and 4. For instance, if one of the worms, such as the worm 20 of FIG. 4, engages an entrainment member and forwardly displaces the same, then a number of trailing entrainment members are dragged along, so that —as best seen by referring to FIG. 3— the damming-up of the entrainment members produced by the worm 19 is diminished in the conveying direction. The worm 19 in turn drags the entrainment members out of the supply which is dammed-up by the worm 20. It should be apparent that the apparatus is operated such that the dam-up supply after the worm 19 or worm 20 respectively, is always filled and thus is practically inexhaustable although the number of dammed-up entrainment members can be subject to fluctuations.

For the operation of the described apparatus it is essential that an entrainment member is associated with each copy of the imbricated product stream, specifically such that upon bringing together the product stream and the train of entrainment members the entrainment member web or the like always is positioned at a spacing behind the trailing edge of the associated printed product. Based upon the showing of FIG. 2, partially also the showing of FIG. 3, it will be seen that the "dam-up spacing", that is to say, the shorter spacing of the entrainment members approximately corresponds to the average imbricated product stream spacing i.e. the stacking of the copies in the product stream. In the ideal case the corresponding measures which are still to be described contemplate that the entrainment member webs are spaced from the associated trailing edge of the product approximately by one-half of the imbricated product stream spacing. These conditions should be maintained in the dam-up zone following the worm 19. Accordingly, the worm 19 imparts to the train of entrainment members a feed speed which corresponds to the speed of the imbricated product stream.

Corresponding to the greater starting pitch of the worm thread 21 of the worm the entrainment members engaged thereby and the entrainment members further dragged thereby possess a greater speed than the feed speed in the dam-up zone after the worm 19. This means that the entrainment members dragged out of the dam-up zone are accelerated, and their entrainment webs or entrainment member webs first overtake the trailing edge of the associated copy and then accelerate this copy to the drag speed, whereby the spacing of the accelerated copy to the next one is enlarged. The imbricated product formation is thus stretched, and the new imbricated product spacing corresponds to the largest spacing of two neighboring entrainment members, i.e. the drag spacing. This is to be distinguished from the configuration shown in FIG. 4 where in accordance with the reduction of the pitch of the worm thread 21 in the worm 20 the active entrainment members are delayed, whereby their entrainment webs detach from the trailing edge of the associated product copy. The product, however, is row engaged by the conveyor band 31 and the contact roll 32 and further conveyed without it changing its position in the imbricated product stream. Due to appropriate selection of the speed of the conveyor band 31 and the contact roll 32 this can be achieved without any problem. In the imbricated product stream arriving at the conveyor band 31 the imbricated product spacing is thus somewhat enlarged in relation to the original spacing, and irregularities of the original imbricated product stream are evened out. Furthermore, there will be recognized from FIG. 4 that the worm 20 is not only decisive as concerns the mutual spacing of the product copies, but also for the position of the product copies in the imbricated product stream. What is meant hereby is the condition that by means of the rotational drive of the worm 20 there can be determined the frequency and phase with which the product copies are delivered. If the worm 20 —as indicated— is coupled by the shaft 30 (or in a different manner) for instance with a stuffing machine or another processing machine, then the product copies of this apparatus are supplied or infed with the frequency and phase determined by the operation thereof.

In the reverse sense the same is valid during the transfer of the imbricated product formation to the entrainment members. In this case the worm 19 must be driven in tune with the frequency and phase of the arriving imbricated product stream such that the trailing edges of the product copies arrive in front of the entrainment web of the associated entrainment member, when they depart from the step which forms the end of the conveyor band 14 which is elevated in relation to the path 15 of the circular path 11. The frequency- and phase-correct synchronization occurs with the aid of the counter 24, the tacho generator 25 and the proximity switch 26 in the following manner:

The rotational speed of the worm 19 is basically determined by the tacho generator 25. The counter 24 determines the phase of the copies. By virtue of the counter signal and the signal of the tacho generator the synchronization device 23 thus obtains information concerning where at a given point in time there is located the trailing edge of the associated product copy (the spacing between the leading and trailing edge is known) and at what speed it is moving forward in the direction of the worm. With the aid of the proximity switch 26, the signals of which are significant for the rotational position of the worm, the speed of the drive motor 22 is influenced by accelerating or braking the same such that the entrainment members are not only infed with the correct frequency, but also with the correct phase to the imbricated product stream. If there exists, for instance, a negative phase error, then the drive motor 22 is momentarily accelerated and it then runs further with the speed determined by the tacho generator. With a momentary delay it is conversely possible to return "hasty" entrainment members back into the correct phase. The individual measures needed for this purpose are well known to those skilled in this art, who has a number of different possibilities which are available in order to insure for the correct operation of the apparatus. Of course, the artisan recognizes in this respect that the drive at the start and at the end of the conveying-active path of the circular path viewed integrally are tuned or matched to one another, and however brief, fluctuations are possible and sometimes necessary.

In regard to what has been said there will now be considered a variant of the drive of the worm 19, there being dispensed with a showing of this modification. It would be possible to imagine that instead of its own drive source the worm is coupled to that of a machine arranged ahead of one of the described devices, for instance a rotary printing press. It would be possible, for instance, to assume that the worm has received its drive from the arm star arrangement or equivalent structure of the rotary printing press. In order to be able to undertake phase corrections there would be arranged forwardly of the worm a differential gearing or planetary gearing, the planetary support of which normally is at standstill. With the aid of an electric motor (preferably of the previously mentioned type) or a stepping motor it would however be possible to drive the planetary support likewise in the one or the other direction, in order to impart to the power take-off gear of this gearing or transmission an additional drive which is effective positively or negatively. In order to insure for the coincidence of the phase of the product copies in the imbricated product stream and the worm also in this case there can be employed a counter and a proximity switch or another position indicator. The tacho generator, by virtue of the direct drive of the worm, then can be omitted. It should be understood that such variation also is conceivable at the output side of the arrangement, i.e. in conjunction with the worm 20. Further, it should be evident that also this worm can be driven for instance in such a manner as the same has been illustrated for the worm 19 in conjunction with the showing of FIG. 1.

Figure 10:
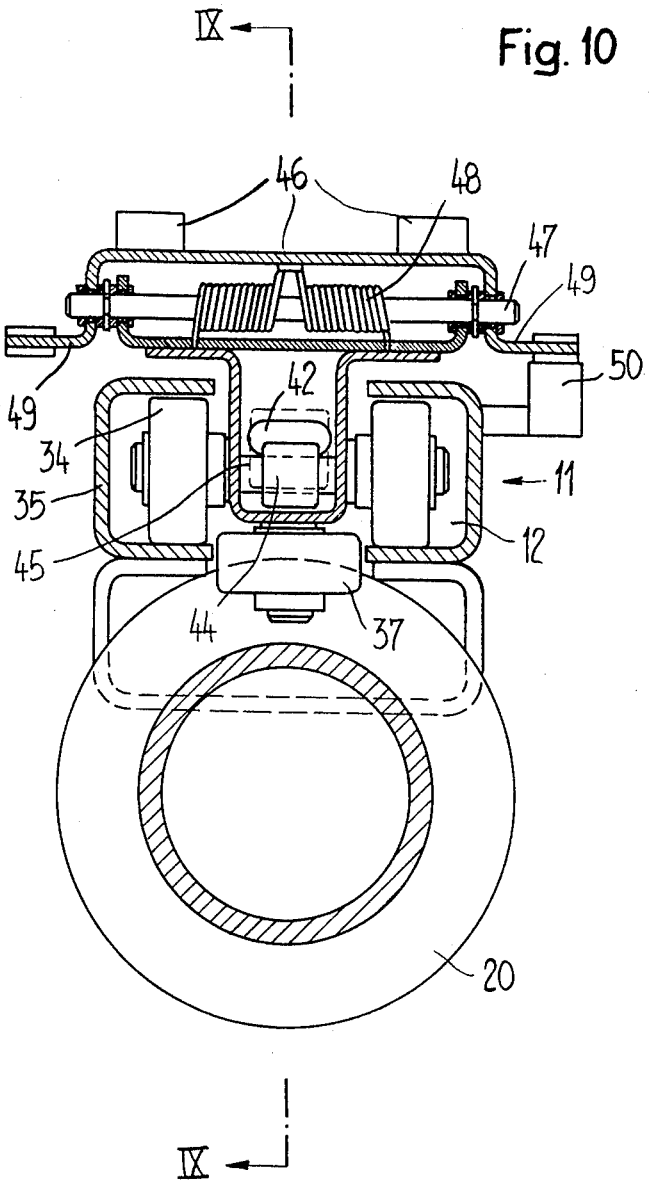
FIG. 10 is a cross-sectional view along the line X—X of FIG. 9.
Figure 11:
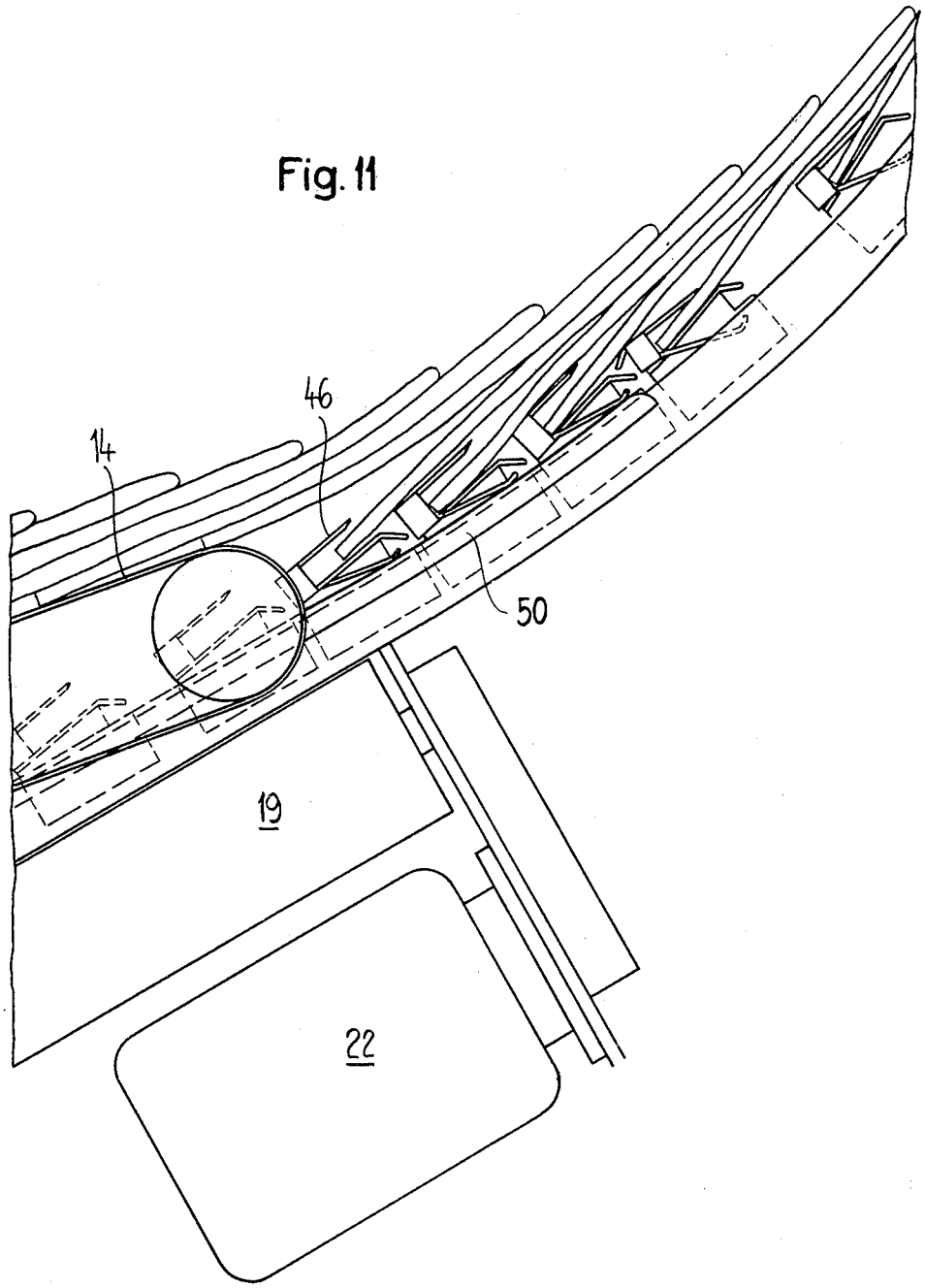
FIG. 11 is a fragmentary sectional view of a section of the path of movement of the entrainment members, the path section corresponding functionally to that of the showing of FIG. 2, but constituting a modified constructional embodiment.

The entrainment members according to FIGS. 8, 9 and 10 differ from the previously described embodiments in that they exhibit a controlled clamping fork 46 which is pivotably mounted at location 47 defining pivot means at the support or bearing plate 38 and bears under the action of an associated spring 48 with the end of its fork tongs **46*a* upon the support plate 38. The clamping fork 46 comprises an actuation arm 49 which cooperates with a cam 50 in order to bring the clamping form 46 into its open position. Such cams 50 or equivalent structure are arranged at the infeed or take-up region and at the outfeed or delivery region. As will be seen from FIG. 10 actuation arm 49 can be provided at both sides of the associated clamping fork or clamping member 46, so that the clamping fork can be actuated by a cam 50 from the one or from the other side. Assuming that the entrainment members are moving towards the right of FIG. 8, then this Figure portrays the entrainment members after they have departed from the worm 20. In order to facilitate the introduction of the trailing edges of the printed copies beneath the clamping forks 46 or into the entrainment hooks 40 (FIG. 6) respectively, it would be possible —as shown in FIG. 11— to impart a convex configuration in the direction of the imbricated product stream to the revolving or circular path at the region of the worm 19. Without any further extensive explanations it should be apparent from this Figure that with such arrangement the product copies, after their trailing edge has reached the end of the conveyor band 14, remains back or slides back and thus in any event is engaged by the opened "gripper mouth" of the associated entrainment member. The clamping forks 46 are of course held open by the cam 50**. Directly after taking-up or engaging the trailing edge of the product copy the clamp forks are released and the product copies are transported while being clampingly engaged up to the delivery location.

Even though it was previously stated that the person skilled in the art could construct in different ways the synchronization device 23 while using his knowledge and expertise, it is here nonetheless further mentioned that in so doing it may be advantageous to use a shift register which is controlled by the cycle or clock disk and the counter. In this way there is followed the printed product and the entrainment member controlled such that it engages in-phase behind the trailing edge of the associated product copy. The sense of this or similar measures will be readily apparent from FIG. 2. In this illustration a product copy E1 just contacts the actuation tongue of the counter 24, wherein however the entrainment member associated with this product copy is still located at a considerable distance (outside of the plane of the drawing). There must be now insured that when this product copy E1 reaches the position of the product copy designated by E2 and located further forwardly in the imbricated product stream, an entrainment member is held in readiness, just as was the case for the product copy E2.

Additionally it should be understood that for instance by shifting the worm 19 in FIG. 11 in the conveying direction it is possible to maintain the momentary speed of the clamping forks at the point in time of transfer of the printed products somewhat greater than that of the imbricated product stream arriving at the conveyor band 14. In this way there is achieved a still greater guarantee that the trailing edge of the taken-over printed products will extend up to the base of the gripper mouth of the clamp forks 46, so that the position of the individual printed products relative to the preceding and the subsequent products is no longer dependent upon chance.

Basically it would be possible to dispense with the drive device 17 and to bring about the drive of the entrainment members only with the aid of the drive device 18. In this case the guide following the drive device 18 and also the arc-shaped path 16 must always be occupied with entrainment members bearing against one another. Such would then be shifted by the drive device or mechanism 18 and accordingly during the thrust operation arrive at the conveying path 15.

While there are shown and described present preferred embodiments of the invention, it is to be distinctly understood that the invention is not limited thereto, but may be otherwise variously embodied and practiced within the scope of the following claims. Accordingly,

What is claimed is:

1. An apparatus for evening an imbricated stream of products, especially printed products, comprising a plurality of revolving entrainment members, each entrainment member engaging a trailing end of an associated one of the printed products, means defining a path of travel for the entrainment members, said entrainment members being movable along said path of travel through a conveying-effective path, means providing a drag connection between the entrainment members, means for guiding the entrainment members at the region of their conveying-effective path, thrust drive means for driving the entrainment members at the start of the conveying-effective path and traction drive means for driving the entrainment members at the end of said conveying-effective path, said drive means constituting a first controllable drive means at the start of the conveying-effective path for driving said entrainment members in pushing relationship to one another and a second controllable drive means at the end of the conveying-effective path for driving said entrainment members in pulling relationship to one another.

2. The apparatus as defined in claim 1, wherein at least one of the drive means comprises a conveying worm having a worm thread, said entrainment members possessing follower elements engaging in the worm thread.

3. The apparatus as defined in claim 2, wherein at least one worm thread possesses a pitch decreasing in the conveying direction.

4. The apparatus as defined in claim 2, wherein the follower elements provided for the entrainment members comprise two follower rolls provided for each entrainment member, said follower rolls engaging with one or the other flank of the worm thread.

5. The apparatus as defined in claim 1, wherein the first drive means is controlled by means of a synchronization device.

6. The apparatus as defined in claim 5, further including an infeed means for the imbricated product stream, a tacho generator for operatively coupling the synchronization device via the tacho generator with the infeed means.

7. The apparatus as defined in claim 5, further including a signal transmitter activated by the products, said first drive means including a drive element, position transmitter means operatively coupled with the drive element of the first drive means, the synchronization device is controlled by the signal transmitter and the position transmitter means.

8. The apparatus as defined in claim 1, wherein each of the entrainment members includes a support plate.

9. The apparatus as defined in claim 8, wherein entrainment web means are arranged on the support plate.

10. The apparatus as defined in claim 8, wherein entrainment hook means are arranged on the support plate.

11. The apparatus as defined in claim 8, wherein controlled clamping fork means are arranged on the support plate.

12. The apparatus as defined in claim 1, wherein the means providing a drag connection between the entrainment members comprises connection elements for interconnecting the entrainment members, each entrainment member having opposite end walls provided at an undercarriage, the connection elements having opposed ends provided with substantially hook-shaped portions which detachably engage into the end walls of the undercarriages of neighboring entrainment members.

13. The apparatus as defined in claim 12, further including shock absorber means provided at each of the connection elements.

* * * * *